US011854757B2

(12) United States Patent
Werner et al.

(10) Patent No.: US 11,854,757 B2
(45) Date of Patent: Dec. 26, 2023

(54) SWITCHING DEVICE WITH TWO STATIONARY CONTACTS AND A MOVABLE CONTACT IN A SWITCHING CHAMBER

(71) Applicant: TDK Electronics AG, Munich (DE)

(72) Inventors: Frank Werner, Berlin (DE); Robert Hoffmann, Berlin (DE)

(73) Assignee: TDK Electronics AG, Munich (DE)

( * ) Notice: Subject to any disclaimer, the term of this patent is extended or adjusted under 35 U.S.C. 154(b) by 0 days.

(21) Appl. No.: 17/822,021

(22) Filed: Aug. 24, 2022

(65) Prior Publication Data

US 2022/0406548 A1 Dec. 22, 2022

Related U.S. Application Data

(63) Continuation of application No. 17/045,290, filed as application No. PCT/EP2019/059545 on Apr. 12, 2019, now Pat. No. 11,462,379.

(30) Foreign Application Priority Data

Apr. 19, 2018 (DE) ..... 102018109403.5

(51) Int. Cl.
*H01H 50/54* (2006.01)
*H01H 50/02* (2006.01)
(Continued)

(52) U.S. Cl.
CPC ..... *H01H 50/546* (2013.01); *H01H 33/08* (2013.01); *H01H 50/023* (2013.01);
(Continued)

(58) Field of Classification Search
CPC .... H01H 50/546; H01H 33/08; H01H 50/023; H01H 50/36; H01H 50/60
See application file for complete search history.

(56) References Cited

U.S. PATENT DOCUMENTS 8,093,974 B2 1/2012 Nagura et al.
9,831,053 B2 11/2017 Haehnel et al.
(Continued)

FOREIGN PATENT DOCUMENTS

CN 1465084 A 12/2003
CN 102737914 A 10/2012
(Continued)

OTHER PUBLICATIONS

Machine translation of DE-102018120984-A1,Grunack , Mar. 2020 (Year: 2018).*
(Continued)

*Primary Examiner* — Bernard Rojas
(74) *Attorney, Agent, or Firm* — Slater Matsil, LLP

(57) ABSTRACT

In an embodiment a switching device includes at least two stationary contacts in a switching chamber and a movable contact in the switching chamber, wherein the switching chamber has a switching chamber wall, wherein each of the stationary contacts projects into the switching chamber through a respective opening in the switching chamber wall, wherein, on an inner side of the switching chamber that faces the movable contact, a continuous surface region occluded from the stationary contacts is located between the openings in the switching chamber wall, wherein the continuous surface region includes a trench, wherein the continuous surface region is arranged between at least two dam-like raised portions extending above the inner side of the switching chamber, and wherein the continuous surface region is arranged symmetrically in relation to the stationary contacts.

20 Claims, 5 Drawing Sheets

(51) Int. Cl.
*H01H 50/36* (2006.01)
*H01H 50/60* (2006.01)
*H01H 33/08* (2006.01)

(52) U.S. Cl.
CPC ..... *H01H 50/36* (2013.01); *H01H 50/60* (2013.01); *H01H 2050/025* (2013.01); *H01H 2050/028* (2013.01)

(56) References Cited

U.S. PATENT DOCUMENTS

| | | | |
|---|---|---|---|
| 2006/0151439 | A1 | 7/2006 | Shea et al. |
| 2010/0060392 | A1 | 3/2010 | Cho et al. |
| 2012/0234624 | A1 | 9/2012 | Takeuchi et al. |
| 2013/0057377 | A1 | 3/2013 | Yano et al. |
| 2013/0301181 | A1 | 11/2013 | Naka et al. |
| 2015/0022291 | A1 | 1/2015 | Kashimura et al. |
| 2016/0071670 | A1 | 3/2016 | Haehnel et al. |
| 2016/0233039 | A1 | 8/2016 | Kanematsu et al. |
| 2016/0365210 | A1 | 12/2016 | Blackmon et al. |
| 2018/0358188 | A1 | 12/2018 | Guo et al. |
| 2019/0228938 | A1 | 7/2019 | Yoo |

FOREIGN PATENT DOCUMENTS

| | | | | |
|---|---|---|---|---|
| CN | 104221115 | A | 12/2014 | |
| CN | 104966646 | A | 10/2015 | |
| CN | 105070590 | A | 11/2015 | |
| CN | 105340044 | A | 2/2016 | |
| CN | 105531783 | A | 4/2016 | |
| CN | 105762022 | A | 7/2016 | |
| CN | 106981400 | A | 7/2017 | |
| CN | 107204254 | A | 9/2017 | |
| CN | 107204257 | A | 9/2017 | |
| CN | 107452551 | A | 12/2017 | |
| CN | 206921752 | U | 1/2018 | |
| CN | 207217414 | U | 4/2018 | |
| DE | 102013210195 | A1 | 12/2014 | |
| DE | 102018120984 | A1 * | 3/2020 | ..... H01H 1/20 |
| EP | 2549498 | A1 | 1/2013 | |
| JP | 2003308773 | A | 10/2003 | |
| JP | 2012104356 | A | 5/2012 | |
| JP | 2012199132 | | 10/2012 | |
| JP | 2015109180 | A | 6/2015 | |
| JP | 2016046007 | A | 4/2016 | |
| JP | 2016520248 | A | 7/2016 | |
| WO | 2015191373 | A1 | 12/2015 | |
| WO | 2017185525 | A1 | 11/2017 | |

OTHER PUBLICATIONS

Hongfa, "High Voltage Direct Current Relay," HFE 18V-100, 5 pages, 2016.

* cited by examiner

SWITCHING DEVICE WITH TWO STATIONARY CONTACTS AND A MOVABLE CONTACT IN A SWITCHING CHAMBER

This is a continuation application of U.S. application Ser. No. 17/045,290, entitled "Switching Device with Two Stationary Contacts and a Movable Contact in a Switching Chamber," which was filed on Oct. 5, 2020, which is a national phase filing under section 371 of PCT/EP2019/059545, filed Apr. 12, 2019, which claims the priority of German patent application 102018109403.5, filed Apr. 19, 2018, all of which is incorporated herein by reference in its entirety.

TECHNICAL FIELD

A switching device is specified.

BACKGROUND

The switching device is embodied, in particular, as a remotely operated, electromagnetically acting switch which can be operated by electrically conductive current. The switching device can be activated via an electrical control circuit and can switch an electrical load circuit. In particular, the switching device can be embodied as a relay or as a contactor, in particular as a power contactor. The switching device may particularly preferably be embodied as a gas-filled power contactor.

One possible application for switching devices of this kind, in particular power contactors, is opening and isolating electrical battery circuits, for example in motor vehicles such as electrically or partially electrically driven motor vehicles. These may be, for example, purely battery-operated vehicles (BEV: "battery electric vehicle"), hybrid electric vehicles which can be charged via a power outlet or charging station (PHEV: "plug-in hybrid electric vehicle") and hybrid electric vehicles (HEV). In general here, both the positive and the negative contact of the battery are isolated using a power contactor. This disconnection is performed in normal operation for example when the vehicle is at a standstill and also in the event of a disturbance such as an accident or the like. The main task of the power contactor here is to switch the vehicle to a deenergized state and to interrupt the flow of current.

The service life of switches of this kind generally ends when the switch no longer has a sufficient insulation resistance in the open state. A switch is usually considered to have failed when a resistance of 50 MΩ is undershot in the open state. At system voltages of, for example, 900 V, powers in the milliwatt range can therefore already occur across the insulation resistor.

A frequent cause of the reduction in the insulation resistance may be erosion of contact materials in the interior of the switch since the materials of the contacts can be removed by switching arcs during the switching processes. These materials are then deposited on the inner walls and form conductive coatings which can lead to bridging of the switching contacts.

SUMMARY

Embodiments provide a switching device, particularly preferably a switching device in which described disadvantages can be prevented or at least reduced.

According to one embodiment, a switching device has at least two stationary contacts and at least one movable contact. The at least two stationary contacts and the at least one movable contact are intended and embodied to switch on and switch off an electrical load circuit which can be connected to the switching device and, in particular, to the at least two stationary contacts. The movable contact can move in the switching device in a corresponding manner between a non-switched-through state and a switched-through state of the switching device in such a way that the movable contact is at a distance from the at least two stationary contacts and is therefore DC-isolated in the non-switched-through state of the switching device and is in mechanical contact with the at least two stationary contacts and is therefore electrically conductively connected to said contacts in the switched-through state. The at least two stationary contacts are therefore arranged in the switching device in a manner isolated from one another and can be electrically conductively connected to one another or electrically isolated from one another by the movable contact depending on the state of the movable contact. The stationary contacts and/or the movable contact can, for example, contain or consist of copper, a copper alloy, one or more high melting metals such as, for example, tungsten, nickel and/or chromium, or a mixture of said materials, for example of copper with at least one further metal, for example tungsten, nickel and/or chromium.

According to a further embodiment, the switching device has a switching chamber in which the movable contact and the at least two stationary contacts are arranged. The movable contact can be arranged, in particular, entirely in the switching chamber. The fact that a stationary contact is arranged in the switching chamber can mean, in particular, that at least one contact region of the stationary contact, which is in mechanical contact with the movable contact in the switched-through state, is arranged within the switching chamber. For connection of a supply line of an electrical circuit which is to be switched by the switching device, electrical contact can be made with a stationary contact, which is arranged in the switching chamber, from the outside, that is to say from outside the switching chamber. To this end, a stationary contact which is arranged in the switching chamber can project out of the switching chamber by way of one portion and have a connection facility for a supply line outside the switching chamber.

According to a further embodiment, the switching device has a housing in which the movable contact and the at least two stationary contacts are arranged. The movable contact can be arranged, in particular, entirely in the housing. The fact that a stationary contact is arranged in the housing can mean, in particular, that at least one contact region of the stationary contact, which is in mechanical contact with the movable contact in the switched-through state, is arranged within the housing. For connection of a supply line of an electrical circuit which is to be switched by the switching device, electrical contact can be made with a stationary contact, which is arranged in the housing, from the outside, that is to say from outside the housing. To this end, a stationary contact which is arranged in the housing can project out of the housing by way of one portion and have a connection facility for a supply line outside the housing.

According to a further embodiment, the contacts are arranged in a gas atmosphere in the housing. This can mean, in particular, that the movable contact is arranged entirely in the gas atmosphere in the housing, and that furthermore at least portions of the stationary contacts, for example the contact regions of the stationary contacts, are arranged in the gas atmosphere in the housing. The switching device can accordingly particularly preferably be a gas-filled switching device such as a gas-filled contactor. The gas atmosphere can promote, in particular, quenching of arcs which can be produced during the switching processes. The gas of the gas atmosphere can preferably have an $H_2$ content of at least 50%. In addition to hydrogen, the gas can include an inert gas, particularly preferably $N_2$ and/or one or more noble gases.

According to a further embodiment, the switching chamber is located within the housing. Furthermore, in particular, the gas, that is to say at least a portion of the gas atmosphere, can be located in the switching chamber.

According to a further embodiment, the movable contact can be moved by means of a magnet armature. To this end, the magnet armature can have, in particular, a shaft which, at one end, is connected to the movable contact in such a way that the movable contact can be moved by means of the shaft, that is to say is likewise moved by the shaft in the event of movement of said shaft. The shaft can, in particular, project into the switching chamber through an opening in the switching chamber. In particular, the switching chamber can have a switching chamber base which has an opening through which the shaft projects. The magnet armature can be moved by a magnetic circuit in order to affect the above-described switching processes. To this end, the magnetic circuit can have a yoke which has an opening through which the shaft of the magnet armature projects.

The shaft can preferably include or consist of stainless steel. The yoke can preferably include or consist of pure iron or a low-doped iron alloy. The switching chamber, that is to say in particular the switching chamber wall and/or the switching chamber base, can preferably at least partially include or consist of a metal oxide ceramic such as, for example, $Al_2O_3$ or a plastic. Suitable plastics are, in particular, those with a sufficient temperature resistance. For example, the switching chamber can include, as plastic, polyether ether ketone (PEEK), a polyethylene (PE) and/or glass-filled polybutylene terephthalate (PBT). Furthermore, the switching chamber can also at least partially include a polyoxymethylene (POM), in particular with the structure $(CH_2O)_n$. A plastic of this kind can be distinguished by a comparatively low carbon content and a very low tendency to form graphite. Owing to the identical contents of carbon and oxygen, in particular in the case of $(CH_2O)_n$, predominantly gaseous CO and $H_2$ can be produced in the case of heat- and, in particular, arc-induced decomposition. The additional hydrogen can boost arc quenching.

According to a further embodiment, the switching chamber has an inner side which faces the movable contact. In particular, the switching chamber wall has a corresponding inner side which faces the movable contact. The switching chamber base likewise has a corresponding inner side which faces the movable contact. The inner side of the switching chamber wall and the inner side of the switching chamber base can together form at least a portion and preferably the entire inner side of the switching chamber.

In the region of the openings through which the stationary contacts project into the switching chamber, the inner side of the switching chamber wall adjoins the stationary contacts. If electrically conductive deposits form on the inner side, for example owing to removal of contact material, an electrically conductive connection can form between the stationary contacts in principle. In order to prevent this, the switching chamber has, on the inner side of the switching chamber that faces the movable contact, a continuous surface region, which is occluded from the stationary contacts, between the openings in the switching chamber wall. This means, in particular, that there is no point of the occluded surface region that can be connected to any point on the surfaces of the stationary contacts via a direct connection through the interior of the switching chamber. Material which can be removed from the contacts during an arc can therefore not directly reach the occluded surface region and therefore cannot deposit on said surface region. The fact that the occluded surface region is continuous can mean, in particular, that any possible path between the stationary contacts via the inner side of the switching chamber wall that would form a leakage current path given a corresponding coating with conductive material is interrupted by the surface region, so that no continuous leakage current path can form between the stationary contacts on the inner side in spite of material being deposited on the inner side of the switching chamber wall.

In particular, the occluded surface region can be formed at least by a portion of a trench which, as seen from the stationary contacts, forms an undercut. Therefore, the occluding effect is achieved by the undercut. The occluded surface region can include or be formed by at least a portion of a base surface of the trench or else the entire base surface. Furthermore, the trench can have trench walls which can form at least a portion of the occluded surface region.

The trench can have, for example, a polygonal cross section. For example, the cross section can be rectangular. Furthermore, the trench can also have a wave-like cross section. A trench with a wave-like cross section can be associated with easier production on account of the lack of edges.

According to a further embodiment, the trench has a width B and a depth T. In particular, $B<T$, and particularly preferably $2 \cdot B<T$. In other words, the trench is preferably deeper than wide, and particularly preferably more than twice as deep as wide. For example, B can be greater than or equal to 0.5 mm and less than or equal to 2 mm. Furthermore, T can be greater than or equal to 1 mm and less than or equal to 4 mm.

The surface region can be embodied in a recessed manner in relation to the surrounding region of the inner side of the switching chamber wall, that is to say as a region of a channel-like, recessed trench. Furthermore, the surface region can also be arranged between at least two dam-like raised portions which extend above the inner side of the switching chamber.

The surface region can particularly preferably be arranged symmetrically in relation to the stationary contacts. This can mean, in particular, that the surface region is arranged centrally and therefore at an equal distance between the stationary contacts.

According to a further embodiment, the switching chamber base has a continuous occluded surface region which can have one or more of the above-described features for the surface region of the switching chamber wall. In particular, the occluded surface region of the switching chamber wall and the occluded surface region of the switching chamber base can form a coherent occluded surface region, so that no continuous leakage current path can form between the stationary contacts on the inner side of the switching chamber.

The problem of a conductive coating being formed can be solved by the continuous occluded surface region since the surface region is formed by an undercut, on which vapor cannot deposit, in the switching chamber. Said undercut is particularly preferably arranged in an encircling manner in the chamber and separates the two stationary contacts in an effective manner even in the event of vapor being deposited on the inner side of the switching chamber.

BRIEF DESCRIPTION OF THE DRAWINGS

Further advantages, advantageous embodiments and developments can be found in the exemplary embodiments described below in conjunction with the figures.

DETAILED DESCRIPTION OF ILLUSTRATIVE EMBODIMENTS

Figure 1A:
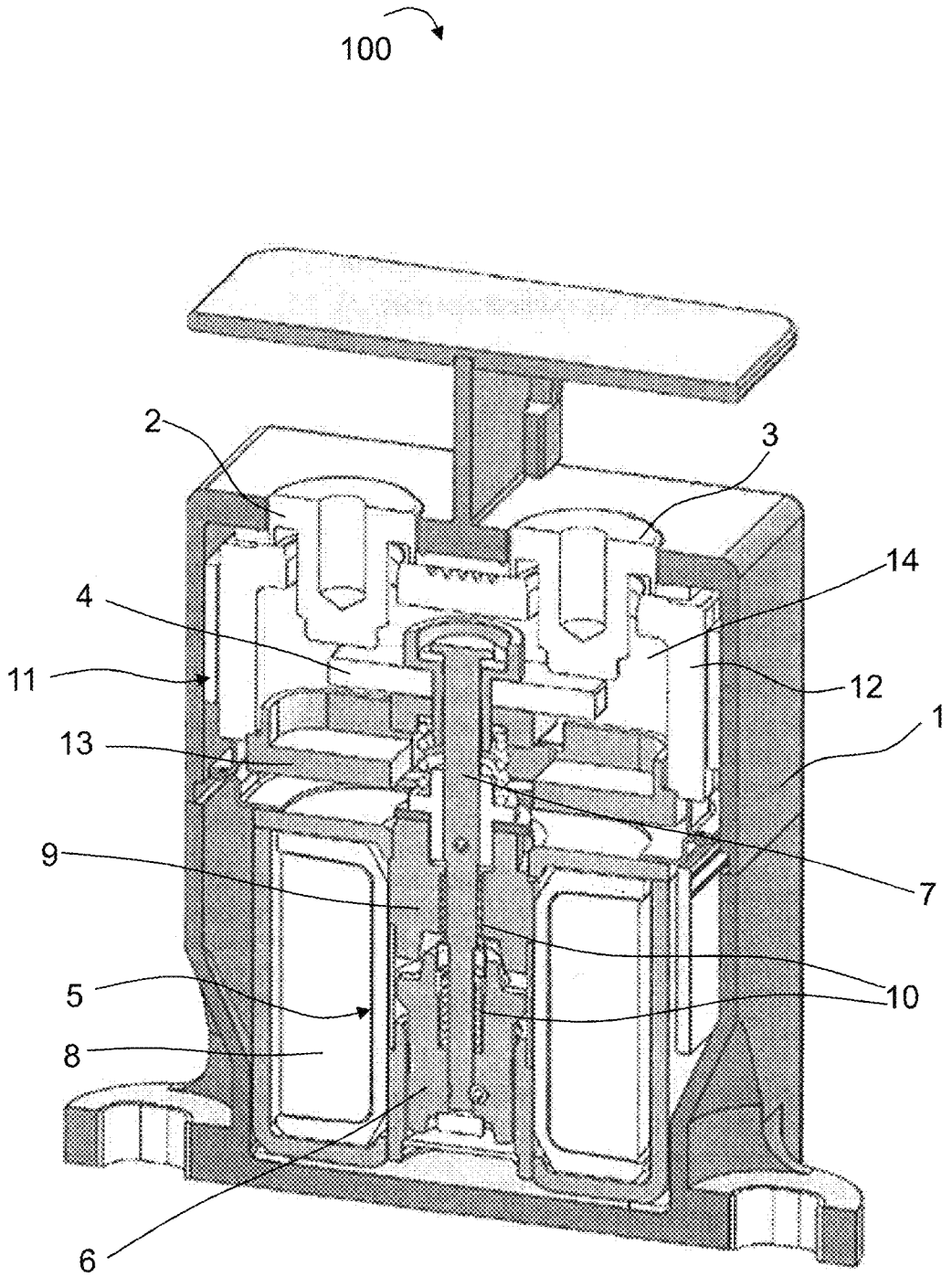
FIGS. 1A and 1B show schematic illustrations of an example of a switching device.

In the embodiments and figures, identical, similar or identically acting elements are provided in each case with the same reference numerals. The elements illustrated and their size ratios to one another should not be regarded as being to scale, but rather individual elements, such as for example layers, components, devices and regions, may have been made exaggeratedly large to illustrate them better and/or to aid comprehension.

Figure 1B:
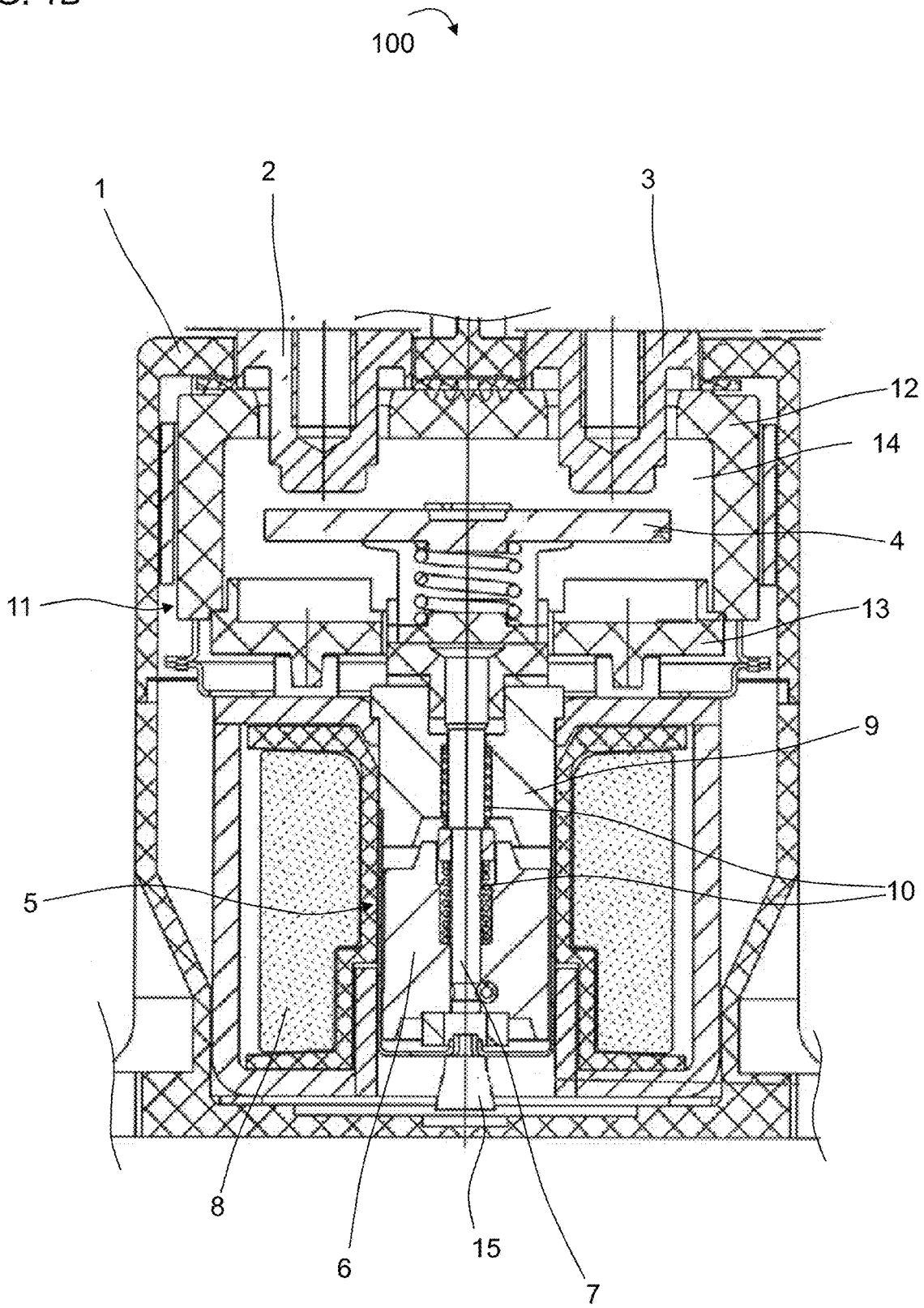

FIGS. 1A and 1B show a switching device 100 which can be used, for example, for switching high electric currents and/or high electric voltages and which can be a relay or a contactor, in particular a power contactor. FIG. 1A shows a three-dimensional sectional illustration, while a two-dimensional sectional illustration is illustrated in FIG. 1B. The description which follows relates equally to FIGS. 1A and 1B. The geometries shown are to be understood merely by way of example and in a non-limiting manner, and can also be embodied in an alternative manner.

The switching device 100 has two stationary contacts 2, 3 and one movable contact 4 in a housing 1. The movable contact 4 is embodied as a contact plate. The stationary contacts 2, 3 together with the movable contact 4 form the switching contacts. The housing 1 serves primarily as protection against contact with the components which are arranged in the interior and includes or consists of a plastic, for example PBT or glass-filled PBT. The contacts 2, 3, 4 can, for example, contain or consist of copper, a copper alloy or a mixture of copper with at least one further metal, for example tungsten, nickel and/or chromium.

FIGS. 1A and 1B show the switching device 100 in an inoperative state in which the movable contact 4 is spaced apart from the stationary contacts 2, 3, so that the contacts 2, 3, 4 are DC-isolated from one another. The design shown for the switching contacts, and in particular the geometry thereof, is to be understood purely by way of example and in a non-limiting manner. As an alternative, the switching contacts can also be embodied differently. For example, it may be possible for just one of the switching contacts to be embodied to be stationary.

The switching device wo has a movable magnet armature 5 which substantially performs the switching movement. The magnet armature 5 has a magnetic core 6, for example comprising or consisting of a ferromagnetic material. Furthermore, the magnet armature 5 has a shaft 7 which is guided through the magnetic core 6 and, at one shaft end, is fixedly connected to the magnetic core 6. At the other shaft end which is situated opposite the magnetic core 6, the magnet armature 5 has the movable contact 4 which is likewise connected to the shaft 7. The shaft 7 can preferably be manufactured with or from stainless steel.

The magnetic core 6 is surrounded by a coil 8. A current flow, which can be introduced from outside, in the coil 8 generates a movement of the magnetic core 6 and therefore of the entire magnet armature 5 in an axial direction until the movable contact 4 makes contact with the stationary contacts 2, 3. The magnet armature 5 therefore moves from a first position, which corresponds to the inoperative state and simultaneously to the isolating, that is to say non-switched-through, state, to a second position, which corresponds to the active, that is to say switched-through, state. In the active state, the contacts 2, 3, 4 are electrically conductively connected to one another. In another embodiment, the magnet armature 5 can alternatively also execute a rotary movement. The magnet armature 5 can be embodied, in particular, as a tie rod or as a hinged armature. If the current flow in the coil 8 is interrupted, the magnet armature 5 is moved back to the first position by one or more springs 10. The switching device wo is then back in the inoperative state in which the contacts 2, 3, 4 are open.

When the contacts 2, 3, 4 are opened, an arc may be formed which can damage the contact areas. As a result, there may be a risk of the contacts 2, 3, 4 remaining "stuck" to one another owing to welding caused by the arc and no longer being separated from one another. In order to prevent the formation of arcs of this kind or at least to assist in extinguishing of arcs which occur, the contacts 2, 3, 4 are arranged in a gas atmosphere, so that the switching device 100 is embodied as a gas-filled relay or gas-filled contactor. To this end, the contacts 2, 3, 4 are arranged within a switching chamber 11, formed by a switching chamber wall 12 and a switching chamber base 13, in a hermetically sealed portion of the housing 1. The housing 1 and, in particular, the hermetically sealed portion of the housing 1 completely surrounds the magnet armature 5 and the contacts 2, 3, 4. The hermetically sealed portion of the housing 1 and therefore also the switching chamber 11 are filled with a gas 14. The gas 14, which can be introduced via a gas-filling port 15 within the scope of the production of the switching device 100, can particularly preferably contain hydrogen, for example with 50% or more $H_2$ in an inert gas or even with 100% $H_2$, since hydrogen-containing gas can promote extinguishing of arcs. Furthermore, there may be so-called blow-out magnets (not shown), that is to say permanent magnets which can extend the arc path and therefore improve extinguishing of the arcs, inside or outside the switching chamber 11. The switching chamber wall 12 and the switching chamber base 13 can be manufactured, for example, with or from a metal oxide such as $Al_2O_3$. Furthermore, plastics with a sufficiently high temperature resistance, for example a PEEK, a PE and/or a glass-filled PBT, are also suitable. As an alternative or in addition, the switching chamber 11 can also at least partially include a POM, in particular with the structure $(CH_2O)_n$.

FIGS. 1A and 1B show a conventional switching chamber 11. Owing to arcs which occur during the switching processes, erosion of contact material can occur, and this contact material can deposit on the inner wall of the switching chamber 11 and can form a conductive coating there. As a result, the insulation resistance between the stationary contacts 2, 3 can be reduced, and this can ultimately result in failure of the switching device.

Figure 2A:
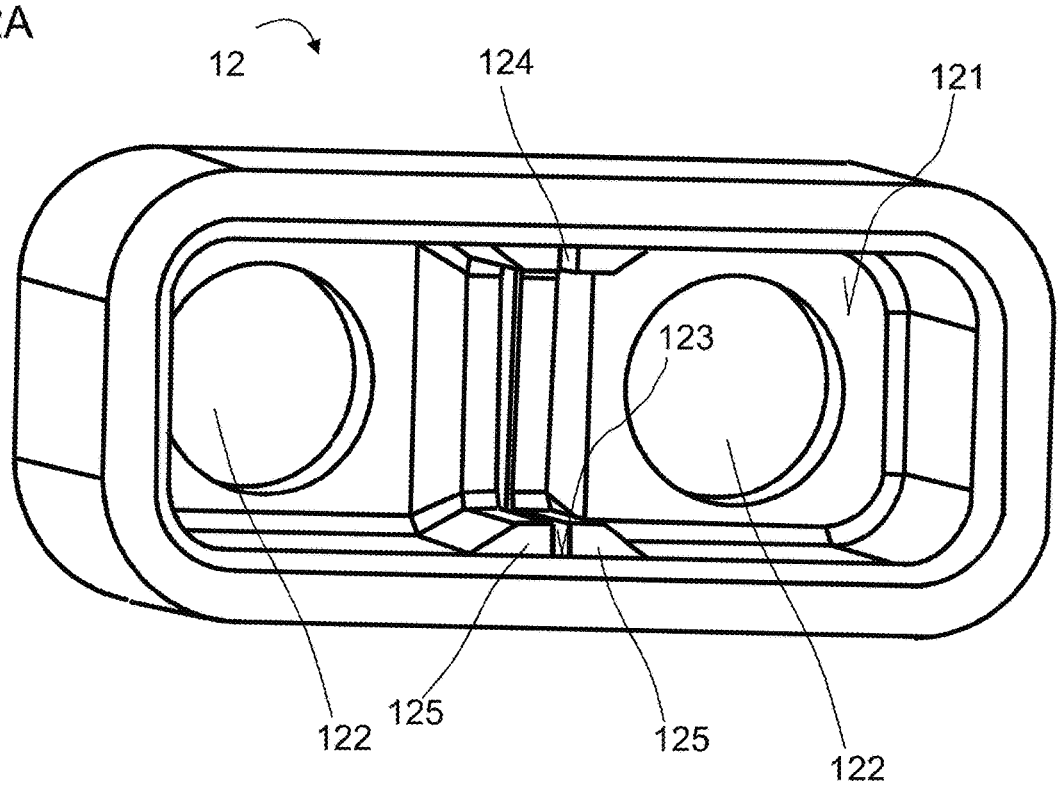
FIGS. 2A to 2C show schematic illustrations of a switching chamber wall and a switching device according to a further exemplary embodiment.
Figure 2B:
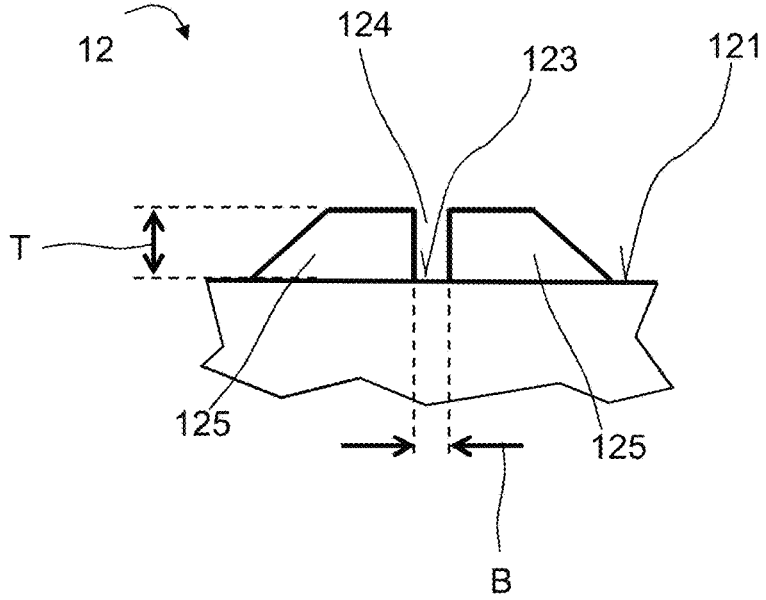
Figure 2C:
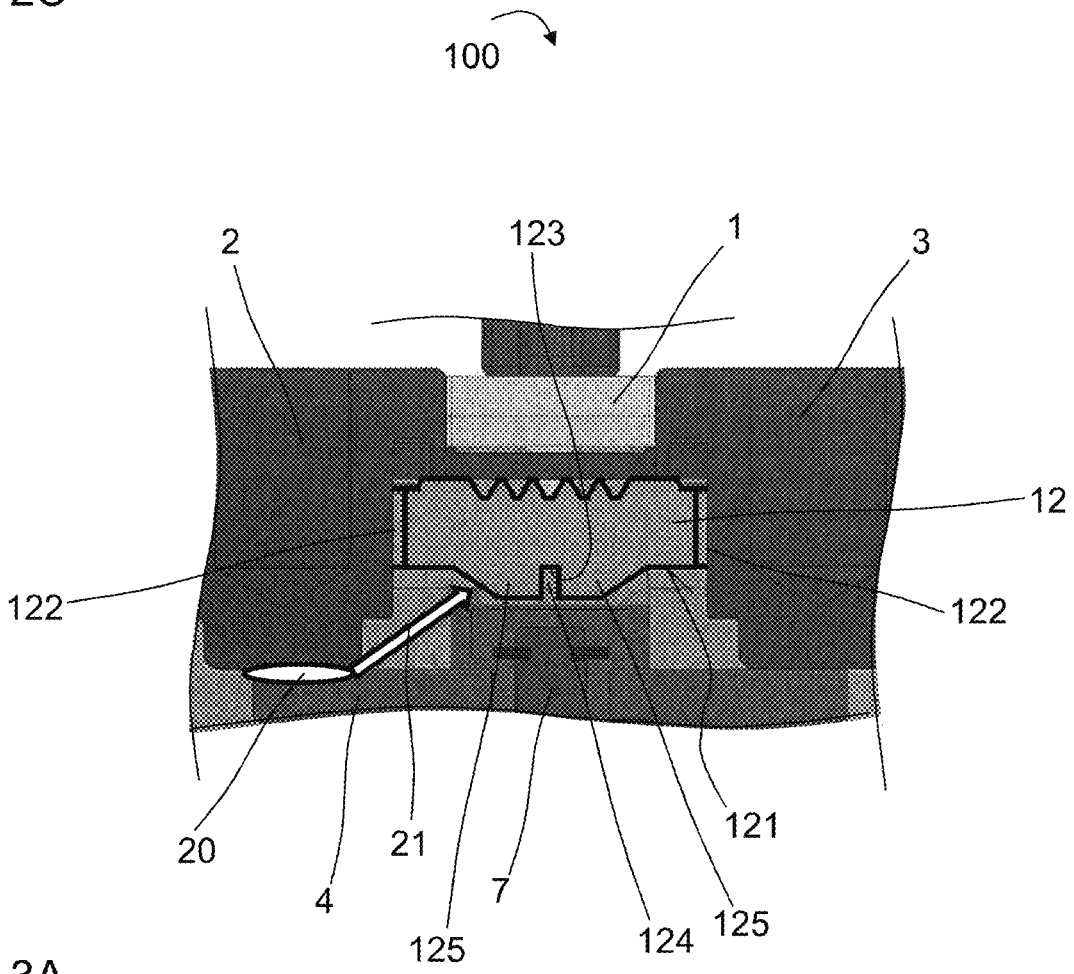

An exemplary embodiment of a switching chamber wall 12 of a switching device wo with which the described problem can be avoided is shown in connection with FIGS. 2A to 2C. FIGS. 2A and 2B show a three-dimensional view and a detail of the switching chamber wall 12. FIG. 2C shows a detail of the switching device boo. The description which follows relates equally to FIGS. 2A to 2C. Components and features of the switching device 100 which are not shown and/or described in connection with FIGS. 2A to 2C can be embodied as described in connection with FIGS. 1A and 1B.

The switching chamber wall 12 has an inner side 121 which forms a portion of the inner side of the switching chamber. The switching chamber base, not shown in FIGS. 2A to 2C, has a corresponding inner side. Openings 122, through which the stationary contacts 2, 3 project into the switching chamber, are present in the switching chamber wall 12. A continuous surface region 123, which is occluded from the stationary contacts 2, 3, is formed between the openings 122 and therefore between the stationary contacts 2, 3.

FIG. 2C indicates, purely by way of example, a material removal region 20 between the contacts 2 and 4, in which region contact material is eroded owing to an arc. The arrow 21 indicates, by way of example, corresponding material removal by way of which contact material can be deposited on the inner side 121. In order to prevent contact material being able to be deposited along a continuous path between the openings 122, the occluded surface region 123 is embodied in such a way that any possible connection between the openings 123 via the inner side 121 is interrupted. The occluded surface region 123 therefore extends continuously from one edge of the inner side 121 of the switching chamber wall 12 to another edge and is formed at least by a portion of a trench 124 which, as seen from the stationary contacts 2, 3, forms an undercut owing to which the occluded effect is achieved. The occluded surface region 123 can have or be formed by at least a portion of a base surface of the trench 124 or else the entire base surface. Furthermore, the trench 124 can have trench walls which can form at least a portion of the occluded surface region 123. As can be seen in FIG. 2A, the surface region 123 is preferably arranged symmetrically in relation to the openings 122 and therefore symmetrically in relation to the stationary contacts 2, 3. This can mean, in particular, that the surface region 123 is arranged centrally and therefore at an equal distance between the stationary contacts.

As can be seen in FIG. 2B, the trench 124 has a polygonal cross section, in particular a rectangular cross section, in the exemplary embodiment shown. The surface region 123 is arranged between at least two dam-like raised portions 125 which extend above the inner side 121 of the switching chamber wall 12. The intermediate space between the dam-like raised portions forms the trench 124. As an alternative or in addition, the surface region 123 can also be embodied in a recessed manner in relation to the surrounding region of the inner side 121 of the switching chamber wall 12, that is to say as a region of a channel-like, recessed trench. The trench 124 has a width B and a depth T. In particular, $B<T$, and particularly preferably $2 \cdot B<T$, as a result of which effective occlusion can be achieved. For example, B can be greater than or equal to 0.5 mm and less than or equal to 2 mm. Furthermore, T can be greater than or equal to 1 mm and less than or equal to 4 mm.

In addition to the switching chamber wall 12 shown, the switching chamber base of the switching chamber can also have a continuous occluded surface region which can have the features described above.

Figure 3A:
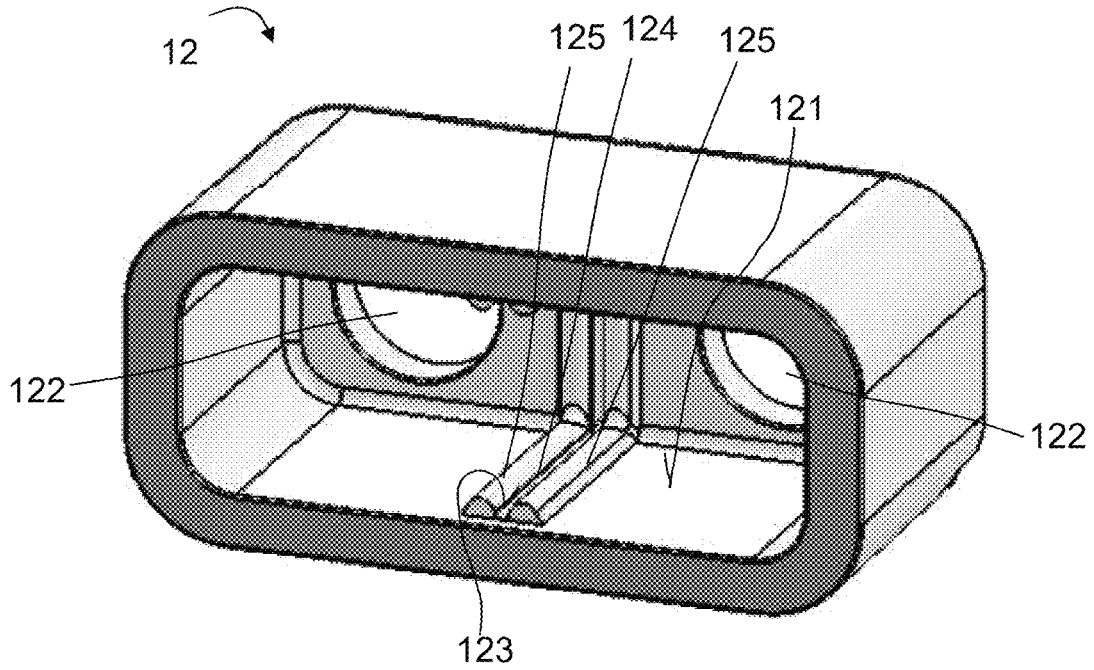
FIGS. 3A and 3B show schematic illustrations of a switching chamber wall of a switching device according to a further exemplary embodiment.
Figure 3B:
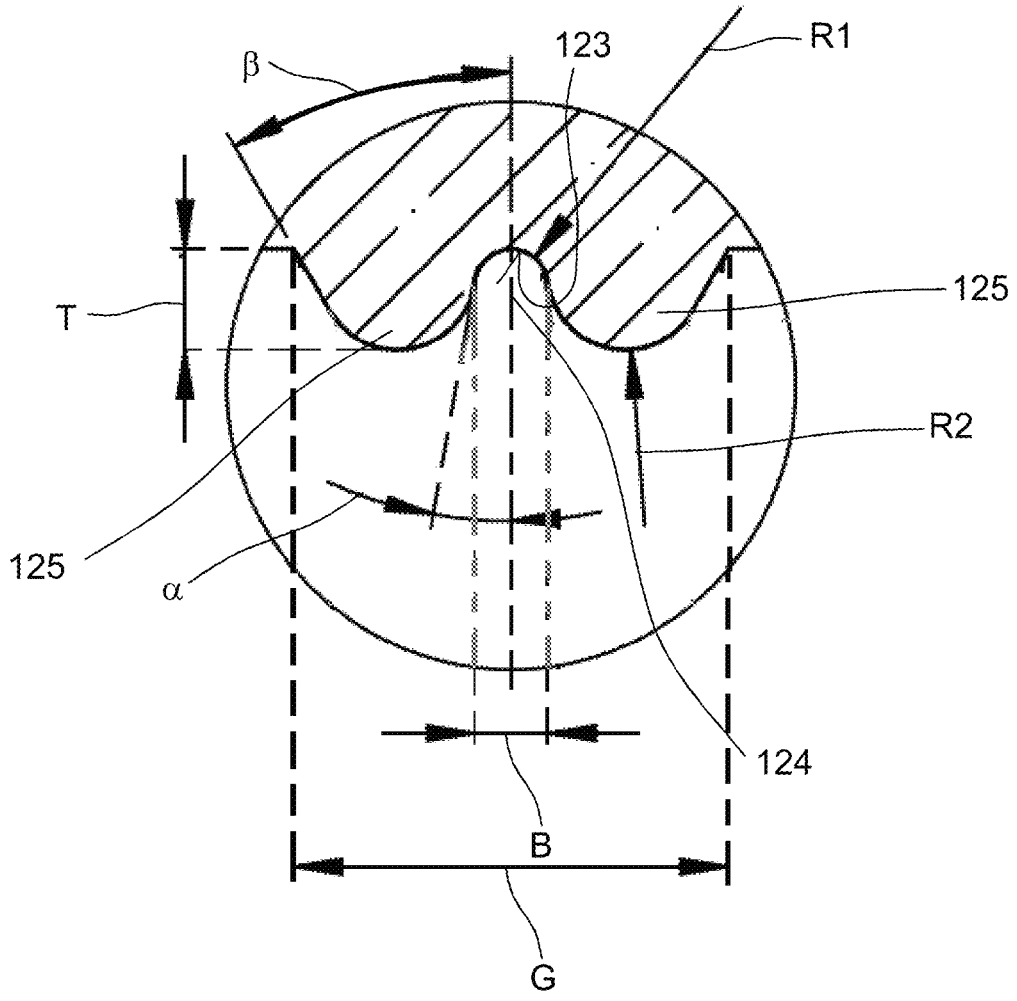

FIGS. 3A and 3B show a three-dimensional view and a detail of a further exemplary embodiment of the switching chamber wall 12. In comparison to the previous exemplary embodiment, the trench 124 is embodied with a wave-like cross section. In comparison to a trench with a polygonal cross section, a trench with a wave-like cross section can be produced more easily, in particular if a shaping process is used for producing the switching chamber wall 12.

In the exemplary embodiment shown, the switching chamber wall 12 can have, for example, external dimensions with a length of approximately 54 mm, a width of approximately 24 mm and a height of approximately 25 mm. The structure which forms the occluded region, which structure is illustrated on an enlarged scale in FIG. 3B, can preferably have an above-described width B and depth T, for example B can be approximately 1 mm and T can be approximately 1.4 mm or more. The entire width G of the structure can be, for example, approximately 6 mm, the radii of curvature R1 at the base of the trench 124 can be approximately 0.5 mm, and the radius of curvature R2 of the dam-like raised portion 125 can be approximately 1 mm. The indicated angles $\alpha$ and $\beta$ can be, for example, 10° and 30°.

The features and exemplary embodiments described in conjunction with the figures can be combined with one another according to further exemplary embodiments, even if not all combinations have been explicitly described. Furthermore, the exemplary embodiments described in conjunction with the figures may alternatively or additionally include further features in accordance with the description in the general part.

The invention is not restricted to the exemplary embodiments by the description on the basis of said exemplary embodiments. Rather, the invention encompasses any novel feature and any combination of features, which in particular includes any combination of features in the patent claims, even if this feature or this combination is not itself explicitly specified in the patent claims or exemplary embodiments.

The invention claimed is:

1. A switching device comprising:

at least two stationary contacts in a switching chamber; and a movable contact in the switching chamber, wherein the switching chamber has a switching chamber wall, wherein each of the stationary contacts projects into the switching chamber through a respective opening in the switching chamber wall, wherein, on an inner side of the switching chamber that faces the movable contact, a continuous surface region entirely occluded from the stationary contacts is located between the openings in the switching chamber wall, wherein the continuous surface region comprises a trench, wherein the continuous surface region is arranged between at least two dam-like raised portions extending above the inner side of the switching chamber, and wherein the continuous surface region is arranged symmetrically in relation to the stationary contacts.

2. The switching device according to claim 1, wherein the trench, as seen from the stationary contacts, forms an undercut.

3. The switching device according to claim 1, wherein the trench has a width B and a depth T, where $B<T$.

4. The switching device according to claim 3, wherein $2 \cdot B<T$.

5. The switching device according to claim 3, wherein B is greater than or equal to 0.5 mm and less than or equal to 2 mm.

6. The switching device according to claim 3, wherein T is greater than or equal to 1 mm and less than or equal to 4 mm.

7. The switching device according to claim 1, wherein the trench has a polygonal cross-section.

8. The switching device according to claim 1, wherein the trench has a rectangular cross-section.

9. The switching device according to claim 1, wherein an intermediate space between the dam-like raised portions forms the trench.

10. The switching device according to claim 1, wherein the trench is formed by a base surface and a respective trench wall of each of the dam-like raised portions, wherein each of the dam-like raised portions has an outer wall remote from the respective trench wall, and wherein the outer walls are inclined with respect to each of the base surfaces and the trench walls.

11. The switching device according to claim 10, wherein each of the at least two dam-like raised portions has a top surface connecting the trench wall and the outer wall and being parallel to the base surface.

12. The switching device according to claim 1, wherein each of the dam-like raised portions is spaced apart from the chamber openings and the stationary contacts.

13. The switching device according to claim 1, wherein the switching chamber wall comprises a metal oxide ceramic.

14. The switching device according to claim 1, wherein a gas comprising H2 is contained in the switching chamber.

15. The switching device according to claim 14, wherein the gas has an $H_2$ content of at least 50%.

16. A switching device comprising:

at least two stationary contacts in a switching chamber; and a movable contact in the switching chamber, wherein the switching chamber has a switching chamber wall, wherein each of the stationary contacts projects into the switching chamber through a respective opening in the switching chamber wall, wherein, on an inner side of the switching chamber that faces the movable contact, a continuous surface region occluded from the stationary contacts is located between the openings in the switching chamber wall, wherein the continuous surface region is formed by a single trench between two dam-like raised portions extending above the inner side of the switching chamber, and wherein the continuous surface region is arranged symmetrically in relation to the stationary contacts.

17. The switching device according to claim 16, wherein the single trench has a width B and a depth T, where $B<T$.

18. The switching device according to claim 17, wherein $2 \cdot B<T$.

19. The switching device according to claim 17, wherein B is greater than or equal to 0.5 mm and less than or equal to 2 mm.

20. The switching device according to claim 16, wherein an intermediate space between the dam-like raised portions forms the single trench.

* * * * *